US005631676A

United States Patent [19]

Karz

[11] Patent Number: 5,631,676

[45] Date of Patent: May 20, 1997

[54] PARALLEL FLOW WATER COOLING SYSTEM FOR PRINTBARS

[75] Inventor: Robert S. Karz, Webster, N.Y.

[73] Assignee: Xerox Corporation, Stamford, Conn.

[21] Appl. No.: 351,095

[22] Filed: Nov. 30, 1994

[51] Int. Cl.[6] ..... B41J 29/377

[52] U.S. Cl. ..... 347/18; 165/908; 400/124.13

[58] Field of Search ..... 347/18, 17, 65; 165/104.19, 104.33, 908; 400/124.13, 719

[56] References Cited

U.S. PATENT DOCUMENTS

| | | | |
|---|---|---|---|
| 4,791,439 | 12/1988 | Guiles | 347/88 |
| 5,017,941 | 5/1991 | Drake | 347/18 |
| 5,316,075 | 5/1994 | Quon et al. | 165/80.4 |

FOREIGN PATENT DOCUMENTS

| | | | |
|---|---|---|---|
| 0754800 | 10/1970 | Belgium | 165/908 |

*Primary Examiner*—Benjamin R. Fuller
*Assistant Examiner*—Craig A. Hallachor
*Attorney, Agent, or Firm*—Finnegan, Henderson, Farabow, Garrett & Dunner

[57] ABSTRACT

A printbar cooling device for cooling an array of print dies substantially eliminates thermal gradients along the length of the array of print dies through use of a parallel flow cooling configuration where each point along the array is in thermal contact with coolant at the same temperature. Coolant is directed away from the array of print dies to a common coolant outlet.

14 Claims, 2 Drawing Sheets

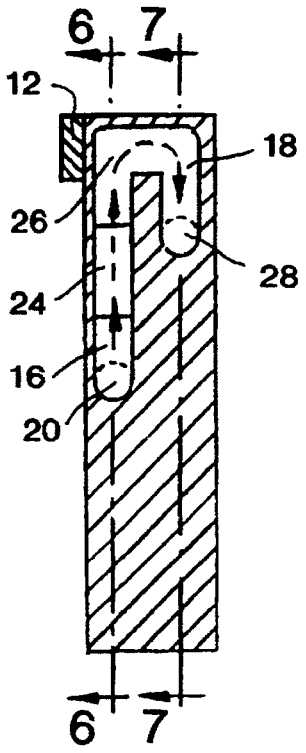
FIG. 4
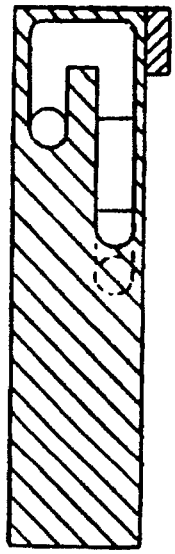
FIG. 5
FIG. 6
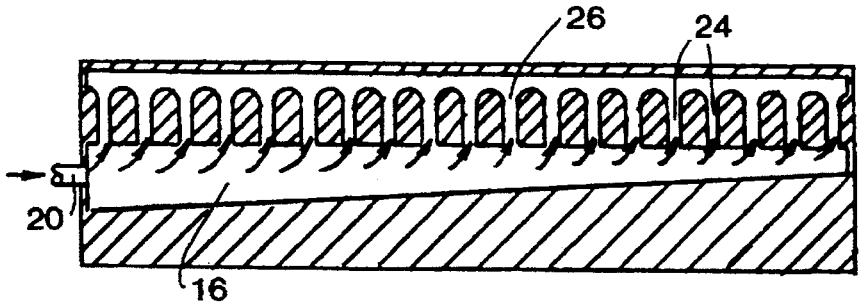
FIG. 7
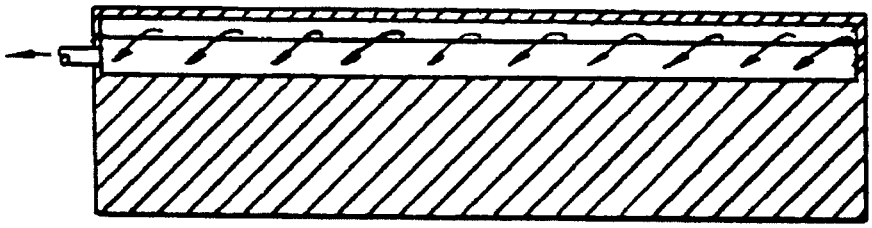

PARALLEL FLOW WATER COOLING SYSTEM FOR PRINTBARS

BACKGROUND OF THE INVENTION

The present invention relates to ink jet printbars and more particularly to a printbar cooling device. Although suitable for any size printbar, it is particularly useful for a full-page-width array of print dies. Full-page-width arrays of print dies require a constant temperature across the entire width of the array to maintain consistent print quality. Each print die contains an ink manifold providing ink to hundreds of minute capillary channels leading to the print face of the printbar. Each capillary channel is individually activated by heating a portion of the ink within the channel, thereby forming a small steam bubble which displaces and propels ink out of the channel onto a sheet of paper. The size of the steam bubble produced, the volume of ink displaced, and the velocity of the displaced ink are highly dependent upon the temperature at which the ink is maintained within the printbar. Through normal operation of the printbar, however, up to several hundred watts of heat are generated. As a result, thermal gradients across the print die array can cause unacceptable variations in bubble and drop size and, in general, adversely affect the operation of the printbar and the resulting print.

Previous cooling systems have been proposed utilizing a single water channel entering into thermal contact with the print die array at one end and flowing the length of the array to an outlet at the other end. At lower flow rates, however, the injected coolant tends to absorb more heat at the inflowing end and less heat as the coolant increases in temperature as it approaches the outflowing end of the array, causing or failing to correct a significant thermal gradient. Because thermal gradients in excess of ±2° C. across the width of the array are undesirable, coolant flow across the length of the array must be increased significantly to minimize the thermal gradient. Increasing the flow rate, however, requires larger, more expensive coolant pumps. In addition, higher flow rates render the system more prone to leakage.

SUMMARY OF THE INVENTION

Accordingly, the present invention is directed to a printbar cooling device that substantially eliminates the disadvantages of the described prior arrangements. The principle advantage of the present invention is the use of an optimal cooling configuration whereby each point along the width of the array is in thermal contact with coolant at substantially the same temperature. This configuration significantly reduces the thermal gradient across the width of the array compared to previous linear methods, and reduces pump size and flow rate requirements for the cooling system, reducing cost and potential for leakage.

Additional features and advantages of the invention will be set forth in the description which follows, and, in part, will be apparent from the description, or may be learned by practice of the invention. The objectives and other advantages of the invention will be realized and attained by the apparatus particularly pointed out in the written description and claims hereof as well as the appended drawings.

To achieve these and other advantages and in accordance with the purpose of the invention, as embodied and broadly described, the invention is a device for cooling an array of print dies comprising a heat exchange gallery in thermal contact with the print dies, a coolant inlet, and a plurality of channel inlets distributed along the heat exchange gallery and connected to channel coolant from the coolant inlet into the heat exchange gallery. A coolant outlet directs coolant out of the heat exchange gallery.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are incorporated in and constitute a part of this specification, illustrate one embodiment of the invention and, together with the description, serve to explain the objects, advantages, and principles of the invention.

In the drawings:

FIG. 4 is a cross-sectional side view along line 4—4 of FIG. 2 of a printbar cooling device in accordance with the present invention;

FIG. 5 is a cross-sectional side view along line 5—5 of FIG. 2 of a printbar cooling device in accordance with the present invention;

FIG. 6 is a cross-sectional top view along line 6—6 of FIG. 4 of a printbar cooling device in accordance with the present invention; and FIG. 7 is a cross-sectional top view along line 7—7 of FIG. 4 of a printbar cooling device in accordance with the present invention.

DETAILED DESCRIPTION OF THE PREFERRED EMBODIMENTS

Figure 1:
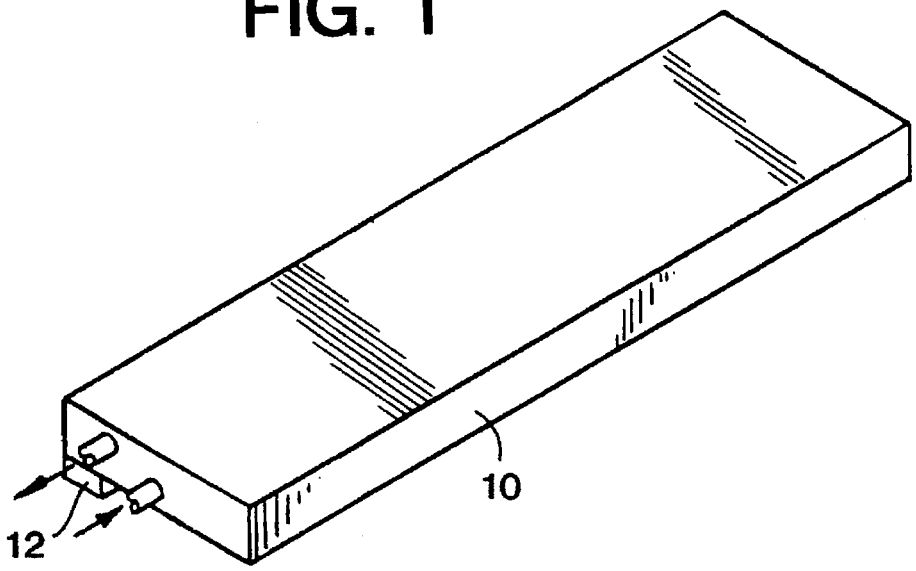
FIG. 1 is a perspective view of a printbar cooling device in accordance with the present invention.
Figure 3:
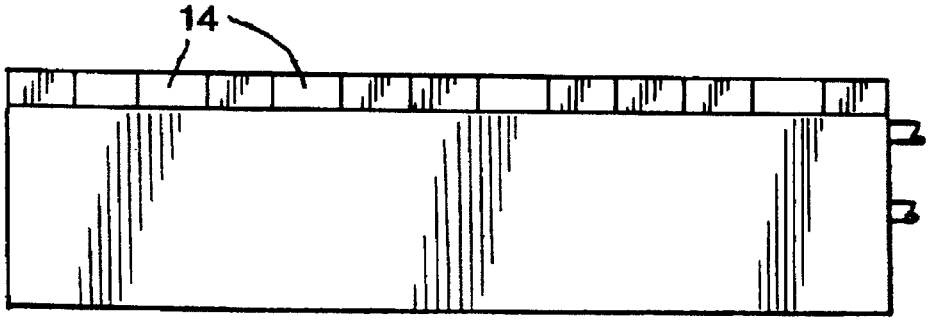
FIG. 3 is a bottom view of a printbar cooling device in accordance with the present invention.

A device for cooling an array of print dies in accordance with the present invention includes a heat exchange gallery in thermal contact with the print dies. An exemplary embodiment of the printbar cooling device of the present invention is shown in FIG. 1. An array of print dies 12 is affixed at one edge of one side of a graphite substrate 10, forming a printbar. The array 12 is depicted in FIG. 3 as including a single-row of print dies 14. Within the graphite substrate 10 two manifolds direct coolant flow. As is described in more detail below, a coolant manifold distributes coolant to various channel inlets, and a collection manifold collects coolant following the coolant's thermal contact with the printbar.

Figure 2:
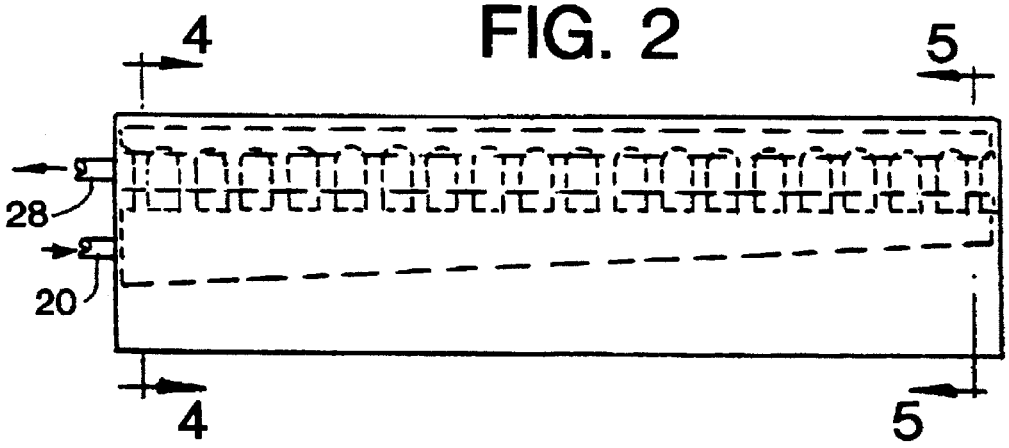
FIG. 2 is a plan view of a printbar cooling device in accordance with the present invention.

FIG. 2 is a plan view of the embodiment of the present invention depicted in FIG. 1. Coolant inlet 20 and outlet 28 deliver coolant to and from the substrate 10. FIG. 4 depicts a cross-sectional view along lines 4—4 of FIG. 2. The coolant inlet delivers coolant to coolant manifold 16. Coolant manifold 16 distributes coolant, preferably in substantially equal amounts, to a series of channels 24. Each channel directs coolant in parallel to a common heat exchange gallery 26. Heat exchange gallery 26 comprises a common chamber where fluid from the channels 24 is introduced. A wall of heat exchange gallery 26 is proximate to and therefore in thermal contact with print die array 12. As shown in FIG. 4, collection manifold 18 collects coolant from the heat exchange gallery 26 and directs it to coolant outlet 28.

The coolant manifold 16 is depicted in FIGS. 2 and 6 as tapering in a direction away from coolant inlet 20 across the width of the print die array. The taper is preferable for quickly delivering substantially equal amounts of coolant to each channel. The taper is not, however, necessary to the proper operation of the present invention, and any appropriate structure delivering coolant to each channel may be used. For example, the coolant manifold 16 may be substantially eliminated altogether, and the channels may simply originate at a common coolant inlet, perhaps located at the rear of graphite substrate 10. Similarly, the channels 24 need not be parallel, and may be distributed in any way effectuating the cooling of print die array 12. As indicated in FIG. 4, after flowing through the channels 24 and into the heat exchange gallery 26, coolant comes into contact with a surface of heat exchange gallery 26 proximate to and therefore in thermal contact with print die array 12. The coolant absorbs heat from print die array 12 and is directed away from the array via collection manifold 18 and coolant outlet 28 depicted in FIG. 7. Because the coolant delivered to the channels 24 and subsequently to the corresponding areas of heat exchange gallery 26 is from a common source and at a common temperature, the coolant will absorb a uniform amount of heat from the print die array 12 at each point along the width of the array. Thus thermal gradients caused by uneven absorption of heat across the width of the array will be eliminated.

The coolant itself may be of any suitable heat absorbing fluid, but is preferably water due to the likely environments where ink jet printers are used.

The printbar cooled by the present invention need not be limited to the linear array of print dies depicted in FIGS. 1 and 3 and discussed above. Various two- and three-dimensional arrays of print dies, and large, uniform-structure dies, are effectively cooled by the present invention with minor modifications of the embodiment described above which would be known to one of skill in the art. Similarly, each of the channels 24 need not be associated with an individual print die of the printbar. Multiple channels per print die or multiple print dies per channel may be implemented.

Thus, it will be apparent to those skilled in the art that various modifications and variations can be made in the disclosed system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claim is:

1. A device for cooling an array of print dies using a coolant, the device comprising:

a heat exchange gallery having a length in thermal contact with the array of print dies;

a coolant inlet directing the coolant towards the heat exchange gallery;

a plurality of channel inlets distributed along the length of the heat exchange gallery and connected to channel the coolant in substantially equal amounts through each of the channel inlets into the heat exchange gallery;

means interconnected between the coolant inlet and the plurality of the channel inlets for distributing substantially equally amounts of coolant to each of the channel inlets; and a coolant outlet directing coolant out of the heat exchange gallery.

2. The device of claim 1, wherein said distributing means comprises a coolant manifold interconnecting the coolant inlet and the plurality of channel inlets for distributing the coolant to each of the channel inlets at substantially a same temperature, the coolant manifold having a length, the length of the coolant manifold and the length of the heat exchange gallery extending generally in a same direction, the coolant manifold narrowing along the length in a direction away from the coolant inlet.

3. The device of claim 2, further comprising a collection manifold interconnected between the heat exchange gallery and the coolant outlet for collecting the coolant from the heat exchange gallery and directing the coolant toward the coolant outlet.

4. The device of claim 3, wherein a cross-section through the coolant manifold, one of the plurality of channel inlets, the heat exchange gallery, and collection manifold of the device provide a generally J-shaped path of travel for the coolant.

5. The device of claim 3, wherein the collection manifold has a length, the collection manifold and the coolant manifold being parallel to and spaced from one another.

6. The device of claim 1, wherein the plurality of channel inlets are evenly spaced along the array of print dies.

7. The device of claim 6, wherein a single channel inlet channels the coolant from the coolant inlet to a surface in thermal contact with and substantially adjacent to a single print die.

8. The device of claim 6, wherein the plurality of channels are parallel to one another.

9. The device of claim 6, wherein each of the plurality of channels have a length, the length of the respective plurality of channels being the same.

10. The device of claim 1, further comprising a collection manifold interconnected between the heat exchange gallery and the coolant outlet for collecting the coolant from the heat exchange gallery and directing the coolant toward the coolant outlet.

11. A device for cooling a printbar including at least one print die using a coolant, the device comprising:

a heat exchange gallery in thermal contact with at least one print die;

a coolant inlet directing the coolant towards the heat exchange gallery;

a plurality of channel inlets distributed along the heat exchange gallery and connected to channel the coolant in substantially equal amount through each of the channel inlets into the heat exchange gallery;

means interconnected between the coolant inlet and the plurality of the channel inlets for distributing substantially equal amount of coolant to each of the channel inlets; and a coolant outlet directing the coolant out of the heat exchange gallery.

12. The device of claim 11, wherein the plurality of channel inlets are evenly spaced along the array of print dies.

13. A device for cooling an array of print dies using a coolant comprising:

means for delivering the coolant towards the array of print dies;

a plurality of channel inlets for directing substantially equal amounts of the coolant at substantially the same temperature to each point along the width of the array of print dies; and means for channelling the coolant away from the array of print dies.

14. A method of cooling an array of print dies, comprising the steps of:

introducing a coolant into a plurality of channel inlets, the coolant being at substantially the same temperature and in substantially equal amounts in each of the channel inlets;

directing the coolant in each channel inlet toward a different point along a width of a surface in thermal contact with the array of print dies; and directing the coolant away from the surface in thermal contact with the array of print dies.

* * * * *